United States Patent [19]

Jordan

[11] 4,325,276

[45] Apr. 20, 1982

[54] NIPPLE ENGAGING TOOL

[76] Inventor: William Jordan, 2990 McVey, Campbell, Ohio 44405

[21] Appl. No.: 190,707

[22] Filed: Sep. 25, 1980

[51] Int. Cl.[3] ..... B25B 13/54

[52] U.S. Cl. ..... 81/441; 81/459; 81/460; 29/78; 29/79; 408/211

[58] Field of Search ..... 81/436, 441, 450, 460, 81/459; 408/211, 268; 29/78, 79; 279/2, 99; 294/96

[56] References Cited

U.S. PATENT DOCUMENTS

| | | | |
|---|---|---|---|
| 1,228,951 | 6/1917 | Morton | 408/211 |
| 1,899,489 | 2/1933 | Wickbergh | 81/441 |
| 2,106,741 | 2/1938 | Herbert | 81/441 |
| 2,362,999 | 11/1944 | Hewitt | 81/436 X |
| 2,480,648 | 8/1949 | Harer | 81/441 X |
| 2,944,453 | 7/1960 | Brewington | 81/441 X |
| 3,211,199 | 10/1965 | Reed | 81/460 |
| 3,365,773 | 1/1968 | Olsen | 408/211 X |
| 3,471,160 | 10/1969 | Sabo | 81/441 |
| 3,602,072 | 8/1971 | Sensat | 81/441 |
| 4,111,078 | 9/1978 | Seamon | 81/441 |

*Primary Examiner*—Donald R. Schran

*Attorney, Agent, or Firm*—Harpman & Harpman

[57] ABSTRACT

A tool for engaging nipples to be applied to or removed from threaded pipe has a plurality of circumferentially spaced longitudinally extending gripping edges formed on elongated members which are arranged in a tapered configuration relative to the longitudinal axis of the tool.

5 Claims, 5 Drawing Figures

NIPPLE ENGAGING TOOL

BACKGROUND OF THE INVENTION (1) Technical Field

This invention relates to tools having tapered portions with means on the tapered portions for engaging the inner surfaces of nipples, bushings or sleeves so that they can be rotated as in removing them from or applying them to pipes and the like.

(2) Description of the Prior Art

Prior devices of this type may be seen in U.S. Pat. Nos. 2,106,741, 3,471,160, 3,602,072 and 4,111,078.

In each of these prior art disclosures single body members having tapered configurations are illustrated as being engagable in various pipes, bushings and the like. In the present invention a plurality of circumferentially spaced elongated members having continuous gripping edges thereon are arranged in spaced relation to one another in a tapered configuration and thereby engagable in nipples, bushings, or the like of varying diameters in a manner that initially resiliently secures the nipple or bushing to the tool while it is positioned on the threaded end of a pipe so that it can be rotated by the tool and spun on to the threaded end easily and quickly.

SUMMARY OF THE INVENTION

A nipple engaging tool comprises a device having a tapered configuration with one small end and one relatively larger end and a plurality of circumferentially spaced elongated members arranged in tapered relation to the axis thereof with each of the tapered members having sharp closely spaced gripping edge configurations therein. A shank and extending shaft are positioned axially on the large end of the device and extend outwardly therefrom so that the device can be secured in the chuck of an electric drill and be rotated thereby. The elongated members preferably take the form of metal cutting files of hardened steel with sharp file grooves extending in angular relation to the several surfaces thereof and defining a large number of closely spaced extremely sharp gripping edges. The arrangement of the elongated members imparts a degree of resiliency thereto which facilitates the engagement of the tool and its gripping edges in a nipple or the like to be turned onto the threaded end of a pipe.

DESCRIPTION OF THE PREFERRED EMBODIMENT

Figure 1:
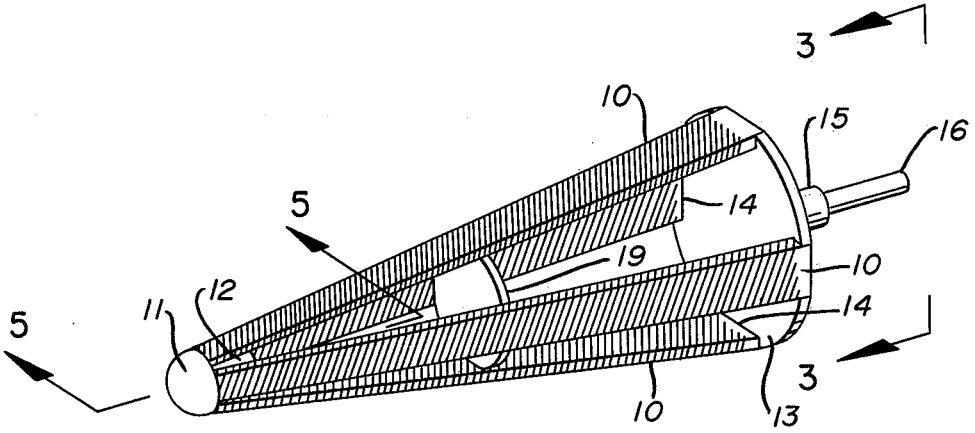
FIG. 1 is a perspective view of the nipple engaging tool.

By referring to the drawings and FIG. 1 in particular, it will be seen that the nipple engaging tool comprises a plurality of elongated members 10 arranged in tapered relation about a common axis and secured at the smaller end of the axis to an end piece 11 which has a rounded outer configuration and an inwardly extending short shaft 12. The larger end of the nipple engaging tool includes a disc 13 having a plurality of circumferentially spaced notches formed therein and a shank 15 with extending shaft 16 secured to the outer surface of the disc 13 on the axial center line of the tool. The elongated members 10 are preferably metal cutting files having angularly disposed closely spaced sharply edged grooves 17 in their outermost surfaces and their longitudinal edges so that the corners of the outer surfaces and the edges define a plurality of sharp points 18 closely spaced and from which the grooves 17 extend continuously.

In a preferred embodiment, a center disc 19 is disposed inwardly of the ends of the nipple engaging tool and attached to the inner surfaces of the elongated file members 10.

Figure 3:
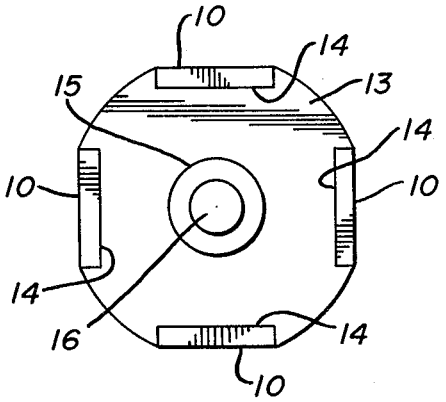
FIG. 3 is an enlarged cross sectional detail of a portion of one of the elongated file-like members of the tool seen in FIG. 1.

By referring to FIG. 3 of the drawings, it will be seen that the disc 13 has the plurality of circumferentially spaced notches 14 formed therein and that the innermost surfaces of the notches 14 are flat and define areas in which the ends of the elongated file members 10 can be positioned and secured as by welding.

Figure 5:
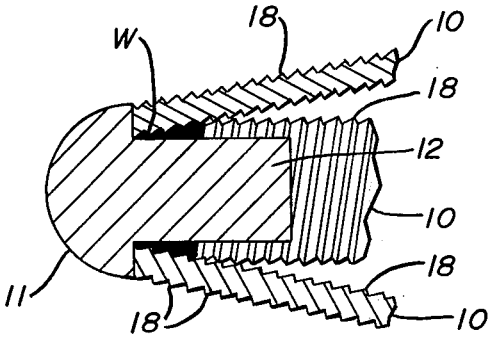
FIG. 5 is a longitudinal cross section on line 5—5 of FIG. 1 in enlarged detail.

In FIG. 5 of the drawings, an enlarged cross sectional elevation of the smaller end portion of the nipple engaging tool may be seen to comprise the rounded end portion 11 with its integral inwardly extending shaft 12 forming a modified T-headed shape with the ends of the elongated file members 10 positioned on the shaft 12 in angular relation thereto and abutting the inner annular surface of the rounded end portion 11. The elongated file members 10 are welded to the shaft 12 as indicated by the letter W.

Figure 2:
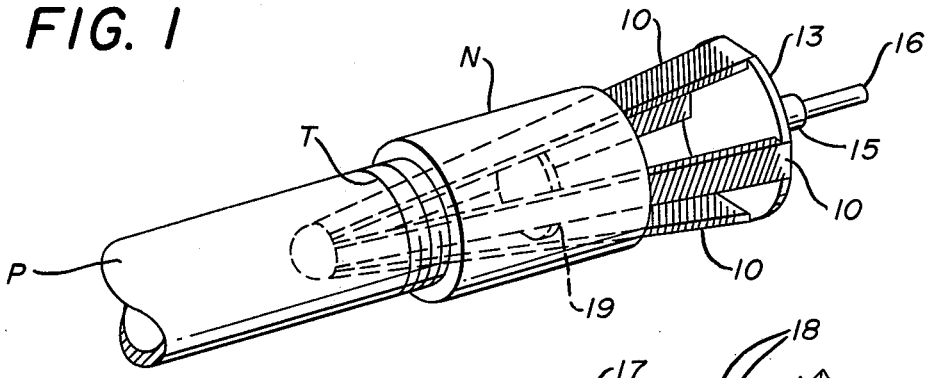
FIG. 2 is a perspective view of the tool engaged in a nipple threadably engaging a pipe end.
Figure 4:
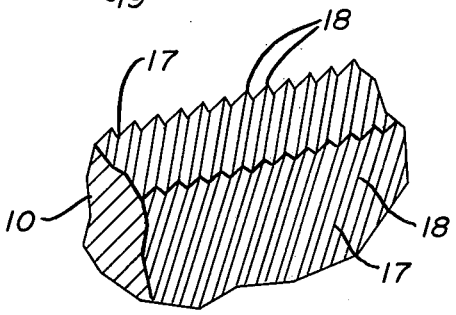
FIG. 4 is an end elevation on line 3—3 of FIG. 1 and in enlarged detail.

In FIG. 2 of the drawings, the device of the invention may be seen to be positioned partially within a nipple N which is partially engaged upon a thread pattern T on a pipe P and it will be observed that when the nipple engaging tool and more particularly the shaft 16 thereof is positioned in a chuck of an electric drill, not shown, it may be rotated thereby after being engaged in the end of the nipple N so as to both hold the nipple and spin it on the threaded end of the pipe P.

The ability of the tool to resiliently engage and hold the nipple is made possible by the radial arrangement of the elongated file members 10 relative to the axial center line of the tool and the relatively large number of the sharp points 18 formed on the longitudinal edges of the file members 10 which engage the material of the nipple N in non-slipping relation. The metal of the elongated file members 10 is considerably harder than the metal of the nipple N.

It will thus be seen that a simple and efficient nipple engaging tool is disclosed which is primarily useful in rapidly and efficiently applying nipples to the threaded ends of pipes and the like and the same tool will easily and handily apply nipples ranging in inner diameters from two inches to four and a half inches.

Having thus described my invention what I claim is:

1. A device for turning threaded fittings onto threaded articles, said device having a continuously tapered body formed of a plurality of elongated metal cutting files, end members of different sizes, said files attached at their respective ends to said end members in tapered relation to an axial center line engaging said end members, said files arranged in circumferentially spaced relation to one another and a shaft formed on one of said end members and extending outwardly therefrom on said axial center line.

2. The device of claim 1 wherein said metal cutting files have right angular longitudinal edges and a plurality of closely spaced sharp points formed on said edges by the surface configurations of said files.

3. The device of claim 1 wherein the metal cutting files are rectangular in cross section and positioned on said end members with their wide surfaces outwardly.

4. The device of claim 1 wherein one of said end members in a disc, and the ends of said metal cutting files are positioned in circumferentially spaced notches in the peripheral edge of said disc.

5. The device of claim 1 wherein one of said end members has a rounded portion and a short shaft extending inwardly therefrom and wherein the ends of said metal cutting files are attached to said short shaft and abut said rounded portion.

* * * * *